United States Patent [19]

Moore et al.

[11] 4,094,019

[45] June 13, 1978

[54] RETRACTABLE TOILET BOWL ASSEMBLY

[75] Inventors: Vincent Moore, Fairview, Pa.; Paul N. Levesque, Bristol, Conn.

[73] Assignees: Altair, Inc., Plymouth, Conn.; American Sterilizer Company, Erie, Pa.

[21] Appl. No.: 709,941

[22] Filed: Jul. 29, 1976

[51] Int. Cl.[2] ..... E03D 1/00; E03D 3/00; E03D 5/00

[52] U.S. Cl. ..... 4/312; 4/1; 4/DIG. 2; 4/345

[58] Field of Search ..... 4/10, 1, 76, 77, DIG. 2

[56] References Cited

U.S. PATENT DOCUMENTS

| | | | |
|---|---|---|---|
| 2,678,450 | 5/1954 | Simpson et al. | 4/10 |
| 2,725,575 | 12/1955 | Colonna | 4/76 |
| 2,750,599 | 6/1956 | Colonna | 4/10 |
| 2,794,988 | 6/1957 | Colonna | 4/10 |
| 2,799,864 | 7/1957 | Colonna | 4/10 |
| 2,826,762 | 3/1958 | Colonna | 4/10 |
| 3,436,764 | 4/1969 | Colonna | 4/10 |
| 3,780,383 | 12/1973 | Katona | 4/10 |
| 3,829,906 | 8/1974 | McPhee | 4/10 |

*Primary Examiner*—Henry K. Artis

[57] ABSTRACT

An assembly havng a retractable toilet bowl incorporates conduit means in the bowl trunnion for delivering water to the toilet bowl via pipes on its underside. The trunnion conduit means incorporates a Sloan valve of standard commerical type to provide advantageous wetting and flushing flow control while providing safeguards against flooding and inadequate sewer gas trap level. The wetting control extends the range of wetness and facilitates cleaning operations. Right and left hand installations, using the same parts, are enabled. Other features as in models currently marketed remain readily incorporatable.

7 Claims, 6 Drawing Figures

FIG. 2
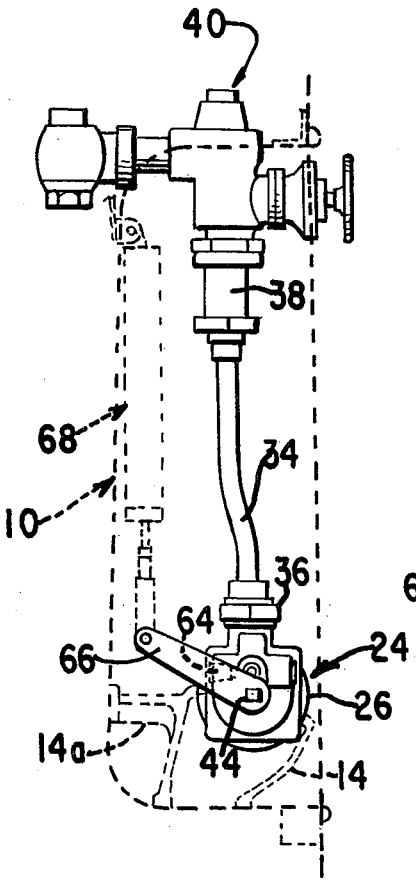
FIG. 1
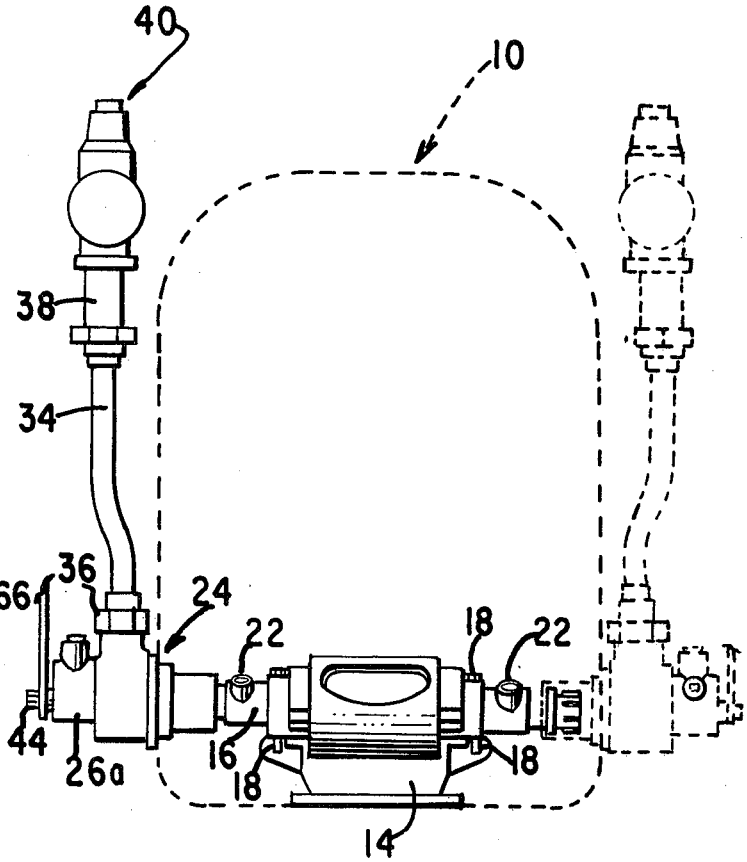
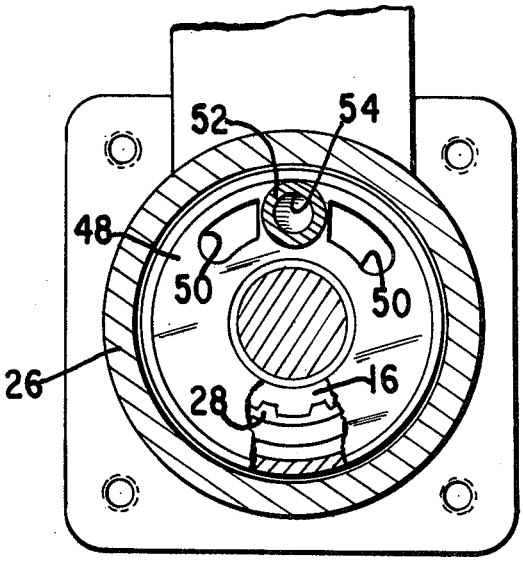
FIG. 5

RETRACTABLE TOILET BOWL ASSEMBLY

INTRODUCTION

This invention relates to retractable toilet bowl assemblies and more particularly to such assemblies incorporating improved mounting and hydraulic systems.

STATUS OF THE ART

Retractable toilet bowls, particularly when combined with lavatories, are in widespread use as space-saving fixtures. Exemplary of such a fixture is that known as MODULAV BAO8, a product of AMSCO, the American Sterilizer Company, Erie, Pa.

OBJECTS OF THE INVENTION

A principle object of this invention is to provide a bowl wetting function as the toilet bowl is being lowered into position to facilitate easy cleaning thereof. A further object of the invention is to provide a simplified construction which is effective and reliable in operation.

THE INVENTION

According to the invention, a fluid flow and valving function is incorporated in the trunnion for the toilet bowl. Water is delivered to an appropriate end of the trunnion, which incorporates a hollowed-out conduit. To effect a bowl wetting function during lowering of the toilet bowl, a radially extending end face of the trunnion is provided with an arcuate slot which communicates with the trunnion conduit. Cooperating with the end face to effect a shear seal therewith, is an axially biased plunger having a radial end face in which a plunger conduit terminates. The other end of the conduit connects to a suitable source of water under pressure.

Water for flushing action is provided to the trunnion via an axial bore in the trunnion terminating in a radial bore in an enlarged end portion of the trunnion. This radial bore is nonaligned with a flush valve source when the toilet bowl is in an elevated position to prevent flooding. It is aligned with the flush valve source when the toilet bowl is in down or use position to enable the desired flushing action on operation of the flush valve.

FEATURES OF THE INVENTION

A feature of the invention is that it can be utilized with other aspects of good toilet bowl fixture design without inhibiting their operation. Thus a controlled rate of fall for the toilet bowl can be ensured through connection to a suitable dash pot device. Flushing with a high flow is enabled through the axial bore terminating in a radial bore of the trunnion by including a normal vacuum breaker in series with a standard flush valve common to other installations in institutions such as hospitals. An important advantage of the wetting arrangement is that as the toilet bowl moves to the retracted position, the arcuate slot remains in aligned relationship with the plunger conduit for a portion of its travel to maintain water flow at a level that will ensure an adequate level of water in the toilet bowl outlet sewer gas trap after siphonic action has been completed. Thus a need for diversion of a portion of the flushing valve flow to a stand pipe or special tank to fill the gas trap after siphonic action, is eliminated. The compact valving arrangement also reduces the number of linkage and plumbing connections required in prior designs.

Among these was the piping to connect the standby pipe with the flush valve and the piping to connect the standby pipe with the flush valve and the trap.

Another feature of the invention is its accommodation of bilateral symetry. This eliminates the need for right and left hand valve units, facilitating location of fixture with respect to other objects while allowing for easy plumbing connections.

A further feature of the invention is that most of the trunnion valving arrangement can be implemented through the deft incorporation of a standard commercial valve. Thus the appropriate end of the trunnion incorporates a Sloan valve.

EMBODIMENT

These and other objects, features, and advantages of the invention will be apparent from reading of the following description of a proposed embodiment of the invention, when considered with the accompanying drawings wherein:

FIG. 1 is a diagrammatic front view showing the toilet bowl in raised position and the plumbing installed on the left hand-side, with a broken line sketch showing plumbing when installed on the right hand side;

FIG. 2 is a left hand view of the toilet bowl of FIG. 1;

FIG. 5 is a cross-sectional view taken along the line 5—5 of FIG. 3;

Figure 6:
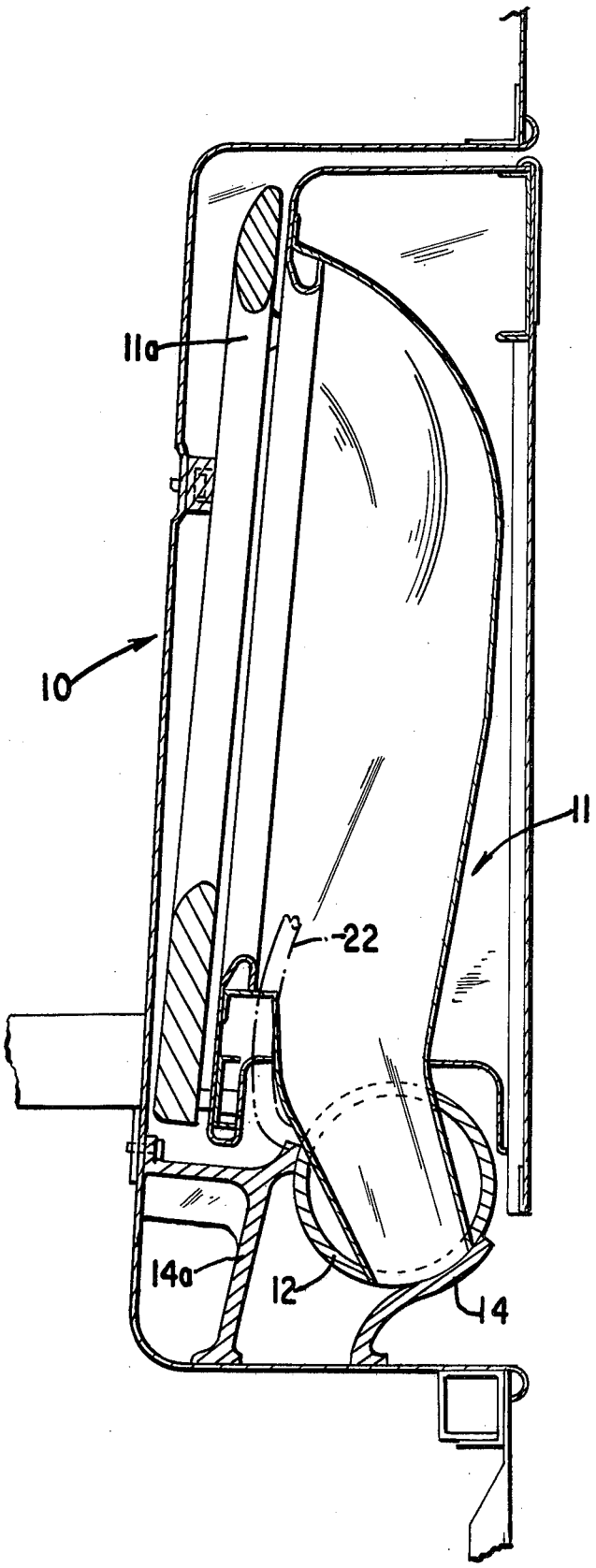
FIG. 6 is a sectional view of a mounted toilet bowl in raised position as seen from the right side.

Referring now to the drawings, there is disclosed in FIG. 1 thereof, an outline of a casing 10 for enclosing a toilet bowl 11 (FIG. 6) in a retracted or raised position. The bowl may be of any standard construction, such as die-formed, mirror-finished stainless steel and having a seat of molded plastic 11*a*. At the lower end, the underside of the bowl is formed into an outlet which is made integral with a pivot cylinder 12 in standard fashion. The cylinder rests rotationally upon a base casting 14 which is intended to be seated on an appropriate sewer gas trap, not shown. The base casting and trap serve as a base or primary support for the toilet bowl. The casing 10 is fixed to the base casting by being sandwiched between the casting and the trap about an appropriate opening and by being bolted to a casting bracket 14*a*.

The end faces of the cylinder 12 are formed with axially extending bosses or trunnions 16, which too, rest on the base casting 14. Stud bolts 18 extend through the trunnion to overlap the base casting 14 and provide additional protection against lateral displacement. As the trunnions extend outwardly from the bolts 18, they are of slightly reduced diameter and contain axial bores or hollowed-out conduits 20 (FIG. 3) extending to their outer ends. Adjacent the bolts 18, they mount on their periphery pipes 22 which lie along the underside of the toilet bowl 10 and communicate at their other ends with the interior of the upper end of the bowl. The pipes 22 communicate with the respective axial bores 20.

At their outer ends, the trunnions are adapted to incorporate Sloan valves generally indicated by 24. A Sloan valve is mounted on the left or right trunnion, depending on whether the plumbing is to be on one side or the other of a fixture. Of course considerations of access, both for installations and for maintenance will govern the decision. The fixture of the invention advantageously accommodates the important consideration. In the embodiment of the invention shown, the Sloan valve is incorporated on the left hand side as seen in FIG. 1, though a right hand installation is also shown but in broken line.

The Sloan valve 24, fitted into the side of the casing 10, includes a valve housing 26 which is generally tubular, though having an outer portion 26a of reduced dimension. The valve housing rotatably contains a valve element 28 (FIGS. 3 and 4) of generally tubular design on its inner end. The dimension of the tubular end of the valve element 28 is such as to receive snugly the other ends of the bosses or trunnion 16. The outer ends of the trunnion are externally grooved and engage with internal grooves in the tubular end of the valve element to align the parts in a splined connection. Two alignments are used, depending on whether a right or a left hand installation obtains. A rubber O-ring 30 seated in a groove defined by two circumferential external ridges on a trunnion serves to define a water seal between the trunnion 16 and the valve element 28. A rubber O-ring 31 defines one water seal between the valve element 28 and the housing 24.

The upper side of the Sloan valve 24 contains an inlet portion 32. Its free end is externally threaded to receive the lower end of a pipe 34 (FIG. 3) in a locked relationship via a nut 36. The upper end of the pipe 34 communicates with a vacuum breaker 38 which is attached to the output side of a flush valve 40, both of a standard design and connection.

The bore of the inlet portion 32 communicates with the interior of the valve housing 26 but is normally closed off therefrom by the tubular valve element 28. However, when the toilet bowl is in the down or in the use position, the valve element will have rotated with the trunnion 16 integral with the pivot cylinder 12 affixed to the toilet bowl 10, to align a radial bore 42 in it with the bore of the inlet portion 32. It will be apparent that in the down position of the toilet bowl, flushing thereof is accommodated, while in the up or retracted position, the flow of water from inadvertent operation of the flushing valve 40 will be blocked by the valve element 28.

Figure 3:
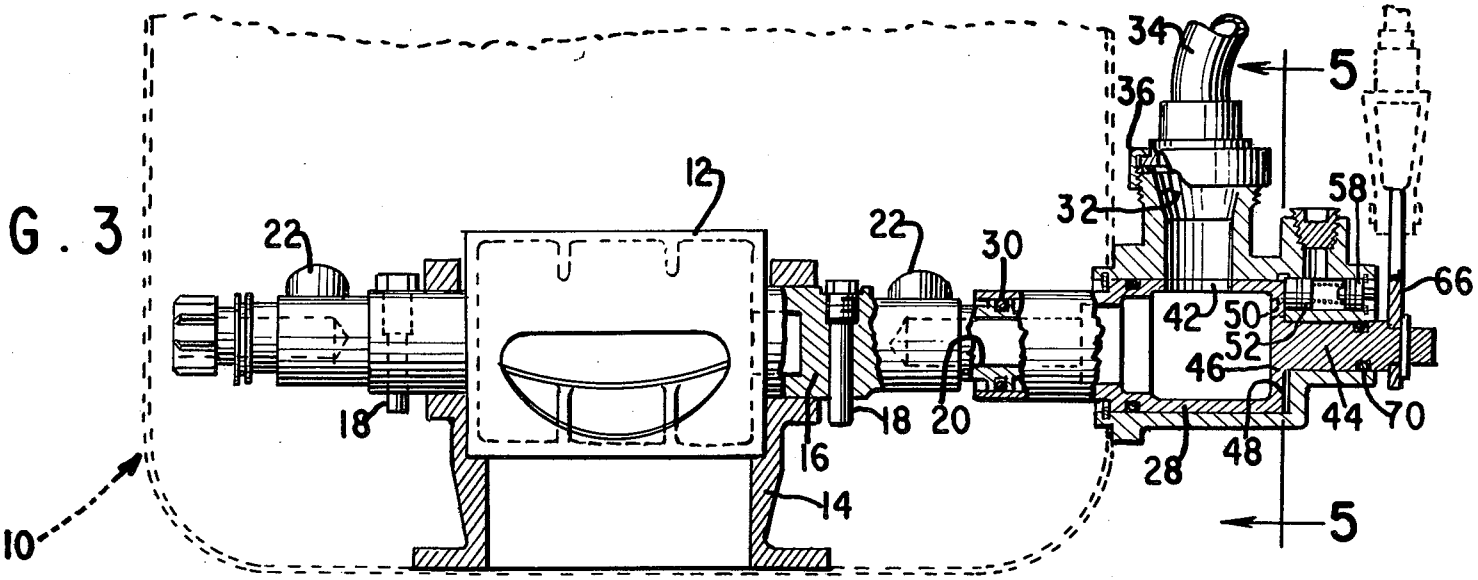
FIG. 3 is a rear view of a portion of the toilet bowl of FIG. 1 enlarged to show the valve mechanism in greater detail.
Figure 4:
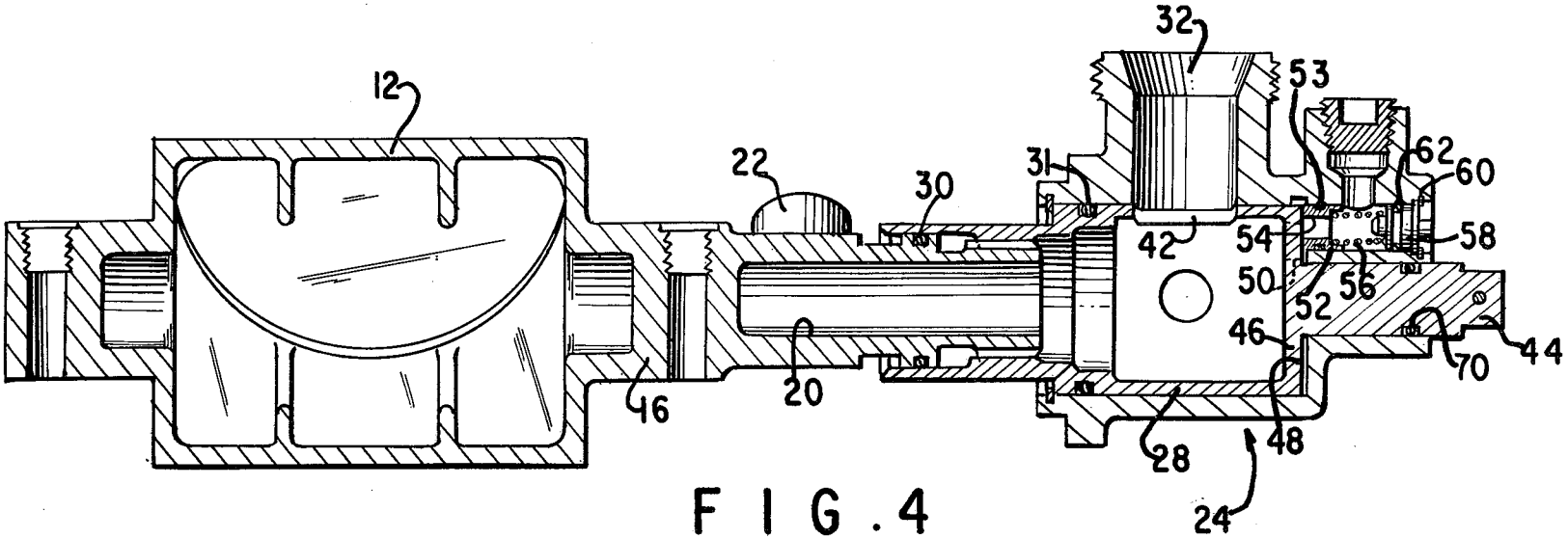
FIG. 4 is a sectional, diagonal view of valve mechanism of FIG. 3.

The right hand end of the valve element 28, as seen in FIGS. 3 and 4, is a solid portion 44 of reduced diameter. The juncture of the solid portion 44 with the rest of the valve element constitutes a radial extending shoulder or side 46 providing a flat surface 48. The surface 48 is formed with a pair of arcuate slots 50 (FIGS. 4 and 5) communicating with the interior of the valve element 28.

A shear seal wetting valve or secondary valve element involving one of the arcuate slots 50 is formed through an axially based plunger 52 having an axial bore 54 terminating in the flat inner end face of the plunger which is biased against the valve element flat surface 48. The plunger 52, which carries a water sealing O-ring 53, is slidably supported in a offset part of the outer portion of the valve housing 26. A spring 56 biases the plunger 52 against or in rebutting relationship with the valve element and is held in place by an end block 58 secured by an expansion ring 60 co-acting with the valve housing. The end block 58 mounts a rubber O-ring 62 to provide a water seal for the outer end of the plunger chamber. An inlet 64 (FIG. 2) serves to deliver water under pressure to the plunger chamber.

As seen in FIG. 5, when the toilet seat is in the up or stored position, none of the arcuate slot 50 in the flat surface 48 of the valve element 28 is aligned with the bore 54 of the plunger 52. However, on slight lowering of the seat, the alignable relationship of the secondary valve element with the valve element is changed as the slot becomes aligned and provides wetting action to the toilet bowl. Wetting of the bowl prior to use facilitates cleansing thereof. In a left hand installation, the other of the arcuate slots 50 would be effective.

The solid portion 44 of the valve element 28 terminates in a square part which seats a lever 66 (FIGS. 1, 2, & 3). The outer end of the lever is suitably connected to a dash pot device 68 of conventional design, to cushion lowering action of the toilet seat. An O-ring 70 on the solid portion 44 water seals. The valve housing 26 is secured to the casing 10 by bolts extending through enlarged holes in the housing (FIG. 5).

In use of the toilet bowl, it is first lowered from a raised or stored position. In doing so, an arcuate slot 50 in the flat surface 48 of the valve element 50 is first brought into alignment with the bore 54 of the plunger 52 of the shear seal wetting valve. Water under pressure in the plunger chamber will flow through the plunger conduit 54, the arcuate slot 50, the interior of the valve element 28, the trunnion bore 20, and the pipe 22 to the front or upper end of the toilet bowl 10, to provide wetting action. The dash pot 68, acting through the lever 66, the valve element 28, the trunnion 16, and the cylinder 12, will cushion any fall of the toilet bowl 10.

After use of the toilet bowl, a flushing action is initiated. Operation of the flush valve 40, acting through the vacuum breaker 38 and pipe 34 will cause flushing water to be delivered through the valve element radial bore 42, the trunnion axial bore 20, and the pipe 22, to the front end of the toilet bowl.

The toilet bowl should be raised to up or stored position after flushing is completed. In so doing, the arcuate slot 50 of the valve element 28 will become aligned for a portion of its travel with the plunger conduit 54. Hence it will ensure that an amount of water is delivered to the toilet bowl outlet sewer gas trap after siphonic action has been completed that is sufficient to provide an adequate water level. The continued wetting action also facilitates cleaning operations, eg. mopping after flushing.

It should be observed that once the seat is in the raised position, that fluid flow due to operation of the flush valve 40 is prevented due to the non-alignment of the valve element radial bore 42 with the valve housing inlet 32.

It will also be observed that while assembly has been described with the respect to valve mounting on one side (Left) of the installation, the assembly of the valve 24, on the other side of the fixture is readily accomplishable. This is because of the second arcuate slot 50 cut in the flat surface 48. Water seals disclosed effectively obdurate leakage.

While there has been shown and described a preferred embodiment of the invention, it will be understood that it was exemplary only and that the scope of the invention is intended to be limited only by the appended claims.

What is claimed is:

1. In a toilet bowl assembly, a base for rotatably supporting and communicating with an element having a cylindrical surface and for communicating with a sewer gas trap, a toilet bowl having up and down positions and secured to said element and emptying thereinto, a valve element axially aligned with and fixed to said element, means for delivering water from said valve element to said toilet bowl, said valve element in the down position of the toilet bowl communicable with a flushing valve, and a secondary valve element in an alignable and abutting relationship with and communicating with said valve element and operable to deliver wetting action flow when the toilet bowl is moved from its up position.

2. A toilet bowl assembly according to claim 1, wherein the valve element is mounted in a housing having an inlet communicating with the flushing valve and includes a radial bore which is out of alignment with the inlet in the up position of the toilet bowl and in alignment therewith in the down position of the bowl.

3. A toilet bowl assembly according to claim 1 wherein the valve element has a radial end surface containing an arcuate slot, and the secondary valve element includes a plunger having a conduit terminating in a radial end surface coacting with the valve element radial end surface and aligned with the arcuate slot therein when the toilet bowl is moved from its up position.

4. A toilet bowl assembly according to claim 2 wherein the valve element has a radial end surface containing an arcuate slot, and the secondary valve element includes a plunger having a conduit terminating in a radial end surface coacting with the valve element radial end surface and aligned with the arcuate slot therein when the toilet bowl is moved from its up position.

5. In a toilet bowl assembly, a base for rotatably supporting and communicating with an element having a cylindrical surface with trunnions extending axially therefrom and for communicating with a sewer gas trap, a toilet bowl having up and down positions and secured to said element and emptying thereinto, a bore formed in the outer end of a trunnion, a pipe communicating between the inner end of the trunnion so as to communicate with the bore therein, a valve element on the outer end of said trunnion and aligned and in communication with the trunnion bore; a housing for said valve element having an inlet adapted to communicate with a flushing valve through a vacuum breaker, a radial bore in said valve element adapted to be aligned with the housing inlet to communicate the trunnion bore with the flushing valve when the toilet bowl is in the down position and to be non-aligned with the housing inlet when the toilet bowl is in the up position, said valve element having a solid reduced end portion so as to provide an offset constituting a radial surface, said housing being formed with a plunger chamber and having an inlet at one end for connection to a source of water under pressure, a plunger having a conduit slidably mounted in the outer end of said chamber and formed with a radial end face slidably engaging the valve element radial surface, a spring biasing the plunger against said valve element, an arcuate slot formed in said valve element radial surface so as to be aligned with the plunger conduit when the toilet bowl is moved from up position to facilitate wetting action by the flow of water from the plunger chamber through the plunger conduit and the arcuate slot and the valve element and the trunnion bore and the pipe to the front end of the toilet bowl, a lever fixed to the outer solid end of the valve element, and a dash pot connected to the lever to cushion any fall of the toilet bowl as it is moved from up position.

6. In a toilet bowl assembly, a base for rotatably supporting and communicating with an element having a cylindrical surface and for communicating with a sewer gas trap, a toilet bowl having up and down positions and rotatably secured on the cylindrical surface of said element and emptying thereinto, a valve element axially aligned with and fixed to said element, means for delivering water from said valve element to said toilet bowl, said valve element in the down position of the toilet bowl communicable with a flushing valve, and a secondary valve element communicating with a said valve element in an alignable and abutting relationship with and and operable when the toilet bowl is moved to the up position to maintain water flow at a rate that will ensure adeqate level of water in the sewer gas trap after siphonic action is completed.

7. A toilet bowl assembly according to claim 6, wherein the secondary valve element also is operable when the toilet bowl is moved from its up position to deliver wetting action flow.

* * * * *